US006664456B2

(12) United States Patent
Momchilovich

(10) Patent No.: US 6,664,456 B2
(45) Date of Patent: Dec. 16, 2003

(54) HARMONIC VIBRATION DAMPING DEVICE FOR MUSICAL INSTRUMENTS AND FIREARMS

(76) Inventor: Philip Momchilovich, 5330 Colorado Ave. NW., Apt. No. 105, Washington, DC (US) 20011

( * ) Notice: Subject to any disclaimer, the term of this patent is extended or adjusted under 35 U.S.C. 154(b) by 8 days.

(21) Appl. No.: 09/824,646

(22) Filed: Apr. 3, 2001

(65) Prior Publication Data

US 2002/0139237 A1 Oct. 3, 2002

(51) Int. Cl.[7] ..... G10D 9/06
(52) U.S. Cl. ..... 84/400; 84/387 A; 84/385 A
(58) Field of Search ..... 42/76.02; 84/400, 84/387 A, 385 A

(56) References Cited

U.S. PATENT DOCUMENTS

| | | | | |
|---|---|---|---|---|
| 59,204 A | | 10/1866 | Fiske | |
| 1,418,039 A | | 5/1922 | Tousey | |
| 2,249,899 A | | 7/1941 | Hogg | 42/76 |
| 3,635,117 A | | 1/1972 | Nagao | 84/380 |
| D223,153 S | | 3/1972 | Murakami | 22/1 |
| 3,732,778 A | | 5/1973 | Bettermann et al. | 89/14 R |
| 4,493,238 A | | 1/1985 | Ricci | 84/282 |
| 4,674,387 A | | 6/1987 | Caruth | 84/304 |
| 4,799,906 A | * | 1/1989 | Perkins, Jr. | 441/85 |
| 4,913,031 A | | 4/1990 | Bossard | 89/14.3 |
| 4,989,491 A | | 2/1991 | Baggs | 84/723 |
| 5,586,545 A | * | 12/1996 | McCaslin | 124/70 |
| 5,644,095 A | * | 7/1997 | Davidson | 84/387 R |
| 5,661,255 A | | 8/1997 | Webb, III | 89/14.05 |
| 5,965,832 A | * | 10/1999 | Davidson | 84/387 R |
| 6,196,108 B1 | * | 3/2001 | Murello | 89/198 |
| 6,230,429 B1 | * | 5/2001 | Smith | 42/76.01 |

OTHER PUBLICATIONS

"Website Description of Heckler & Koch Clock 'O' Ring Barrel Bushing System for Pistols", http://www.ccfa.com/glockori.htm/ Downloaded Feb. 14, 2001.

* cited by examiner

*Primary Examiner*—Kimberly Lockett
(74) *Attorney, Agent, or Firm*—Armstrong, Westerman & Hattori, LLP

(57) ABSTRACT

Resilient material and/or rubber O-rings are placed at various predetermined locations to reduce unwanted sympathetic vibrations on musical instruments and firearms. This improves the performance and sound of musical instruments and makes them easier to play. The resilient material improves shooting accuracy, produces a tighter grouping of firings, and reduces flash, report and recoil of firearms.

5 Claims, 22 Drawing Sheets

VIOLIN BOW

VIOLA BOW

CELLO BOW

DOUBLE BASS BOW

PICCOLO

FLUTE

OBOE

ENGLISH HORN

CLARINET

BASSOON

TRUMPET

FRENCH HORN

TROMBONE

TUBA

TRUMPET

TRUMPET

TRUMPET

FRENCH HORN

TROMBONE

TRUMPET

HARMONIC VIBRATION DAMPING DEVICE FOR MUSICAL INSTRUMENTS AND FIREARMS

BACKGROUND OF THE INVENTION

1. Field of the Invention

This invention concerns musical instruments and, more particularly, wind instruments. One type of wind instrument is mainly made of metal and uses a cup mouthpiece and convoluted, generally cylindrical or slightly tapering tubing terminating in a flared end or "bell". This type of instrument is commonly referred to as a "brass" instrument, even though often constructed of other bright metals such as silver, nickel, etc. Another type of wind instrument, called a "woodwind", uses a wooden reed caused to vibrate by the focusing of an air column from the mouth of the human player to create sound. The invention is also applicable to stringed instruments, in which the sound vibrations are produced by the relative movement of a bow against the strings of the instrument. The invention is also applicable to firearms.

2. Description of the Related Art

In brass instruments, resonance of the air column occurs at various pitches of sounds produced by the musician's lips at the mouthpiece. In woodwinds, the sound is generally produced by the reed, as in the clarinet, or by the focusing of an air column into a hole at one end, as in the flute. Resonance is caused by the bell of the instrument. Resonance assists the musician in obtaining the tone he desires and also acts to amplify the sound the musician's lips generate at the mouthpiece. The pitches at which resonances will occur depend on the length of the tube defining the "air column" or the path along which the sound travels through the instrument. The tubing length is sufficiently long as to require forming the tubing in loops, as is done in the trumpet, French horn, tuba, and other brass instruments. In woodwinds, the distance the air travels through the instrument is varied by the opening and closing of various holes along the length of the instrument, thereby providing different resonance frequencies. In stringed instruments, the different resonance frequencies are produced by causing different lengths of strings to vibrate by action of the movement of the bow across them.

In addition, in a brass instrument such as the trumpet, three valves are used to allow the musician to selectively vary the length of the tubing in order to enable resonances to be achieved for each note of a complete musical scale. Each valve is received in one of a bank of valve casings located along the length of the main tubing. The valves allow one of respective U-shaped slide tubes of different lengths to be placed in communication with the tubing defining the air column of the instrument to, in effect, vary the length of the air column, shifting the pitches at which resonances will occur.

Resonance necessarily involves a reflection of sound at the bell back into the instrument, but reflection at other points in the bore of the tube is known to cause degeneration of tone. These unwanted reflections may be caused by irregularities along the tube.

Wind instruments act as "coupling" devices which amplify the tones produced by the musician's lips, and/or the reed, and this amplification is at its greatest efficiency at the resonant frequencies. Coupling efficiency affects instrument responsiveness (the ease in which the instrument produces a desired tone in response to the efforts of the musician).

It is well-known in the prior art to produce an improvement in tone quality and responsiveness in musical instruments by strategically placing damping material at specified positions on the instrument.

U.S. Pat. No. 5,644,095 to Davidson discloses an improvement to the tone and responsiveness of brass instruments achieved by holding preshaped pieces of damping material, preferably a waxy, hot-melt adhesive, pressed against surfaces of the instrument tubing sections such as valve casings and tubing sections at particular locations, to reduce sympathetic vibrations of the instrument structure.

U.S. Pat. No. 59,204 to Fiske discloses the interposing of rubber or another suitable elastic substance between the attachments of the main pipe with the bell of a wind instrument.

U.S. Pat. No. 3,635,117 to Nagao discloses a ring fixing structure for a woodwind musical instrument. Rings are fixed around the elongated hollow bodies of the woodwind musical instrument, such as their joints and bell edge for reinforcing and ornamental purposes, grooves are formed, respectively, in opposite portions of the elongated hollow bodies and rings, and an adhesive of hot-melt-type is inserted and disposed in the grooves.

After fitting the ring to the elongated hollow body with both grooves facing each other, the adhesive is heated into a melted state and solidified, and the ring and the elongated hollow body are firmly adhered to each other.

U.S. Pat. No. 4,493,238 to Ricci discloses a violin bow having a weight mounted on the rod section of the bow so that both the magnitude of the weight and the position of the weight relative to the tip of the bow are adjustable. This structure enables tuning of the bow with respect to its bounce characteristics so that the bow will bounce on the violin strings with a speed and force considered desirable by the artist handling the bow.

In regard to firearms, it is well-known to produce vibration damping devices for improving their accuracy.

For example, U.S. Pat. No. 5,661,255 to Webb, III, discloses a weapon barrel oscillation reduction apparatus including a plurality of donut shaped rings or washers mounted on the muzzle end portion of a weapons barrel. The weapon barrel has breech and muzzle end portions and provides a machined ring carrying outer surface at the muzzle end portion. An annular shoulder at one end portion of the ring carrying portion acts as a stop for the plurality of rings mounted thereon. A retainer can be removably attached to the opposite end of the ring carrying surface. Upon assembly, the rings can move slightly in a longitudinal direction with respect to each other during a firing of a projectile from the weapons barrel, where the weight of the rings and the slight movement of the rings function to reduce barrel oscillation.

U.S. Pat. No. 4,913,031 to Bossard et al. discloses a vibration damping device for improving the hit accuracy of a firing weapon. In the case of weapon barrels, which are only secured at one of their ends at the weapon housing during firing of the weapon there occurs, particularly during series firing, bending vibrations or oscillations which impair the hit probability of the fired projectiles. In order to preclude or at least dampen such bending vibrations of the weapon barrel the invention contemplates securing a vibration damping device or damper at the muzzle of the weapon barrel. This vibration damper comprises an inertia body, which is resiliently connected with the weapon barrel muzzle. Also provided is a brake device, which dampens the movement of the inertia body relative to the weapon barrel.

The inertia body preferably comprises two ring members which are pressed by springs against two disc members which are rigidly attached to the weapon barrel muzzle. Between the weapon barrel and the ring members of the inertia body there are arranged resilient elements, such as blade or leaf springs.

It has heretofore been recognized that factors which reduce coupling efficiencies include the incidence of "sympathetic" harmonic vibrations, i.e., mechanical vibration of the instrument parts, whether it be in musical instruments or firearms.

Thus, there is a need in the art to improve the responsiveness and tone of musical instruments by minimizing unwanted sympathetic harmonic vibrations. Such a reduction in sympathetic harmonic vibrations along the muzzle of a firearm is also desirable in order to reduce the audible report and to increase accuracy.

SUMMARY OF THE INVENTION

The present inventor has discovered that the tone, responsiveness and frequency range of brass instruments can be greatly improved by providing localized damping at particular effective locations on the valve casings tubings and bracings of the instrument providing pieces of vibration absorbent damping material at the exterior surface at those locations. In woodwinds, the present inventor has discovered that the same type of audible improvement is produced by providing the pieces of vibration absorbent damping material at locations along the barrel of the instrument itself. In stringed instruments, the vibration absorbent damping material should preferably be placed at the tip and winding ends of the stick portion of the bow.

In firearms, the vibration absorbent damping material should preferably be placed at a specific location on the barrel.

The vibration absorbent damping material preferably consists of various numbers of elastic rubber O-rings placed at the various particular effective locations, the number and precise locations of the O-rings depending upon the type of instrument, the variations in the construction of different brands and models of instruments, and the desired amount or degree of vibration absorbent damping desired in order to subtly change timbre for a particular style of playing, such as jazz or classical.

DESCRIPTION OF THE PREFERRED EMBODIMENTS

Figure 1:
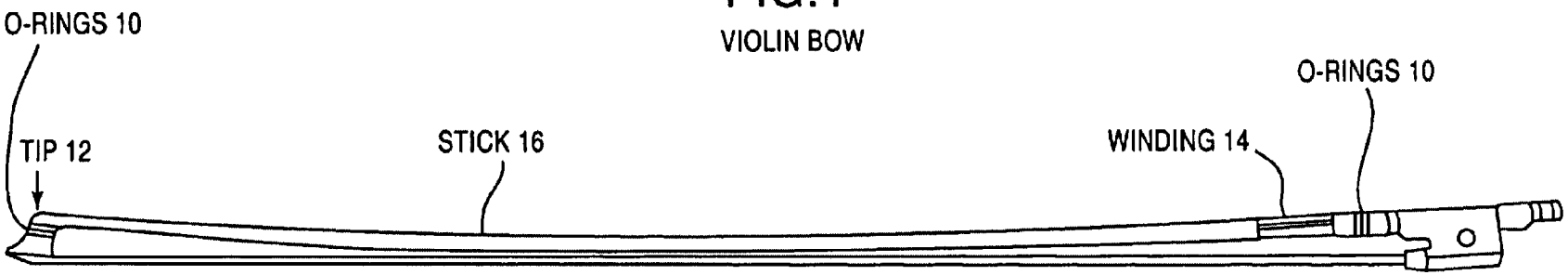
FIGS. 1–4 are plan views of various stringed instruments showing the preferred locations of the O-rings according to the present invention.
Figure 2:
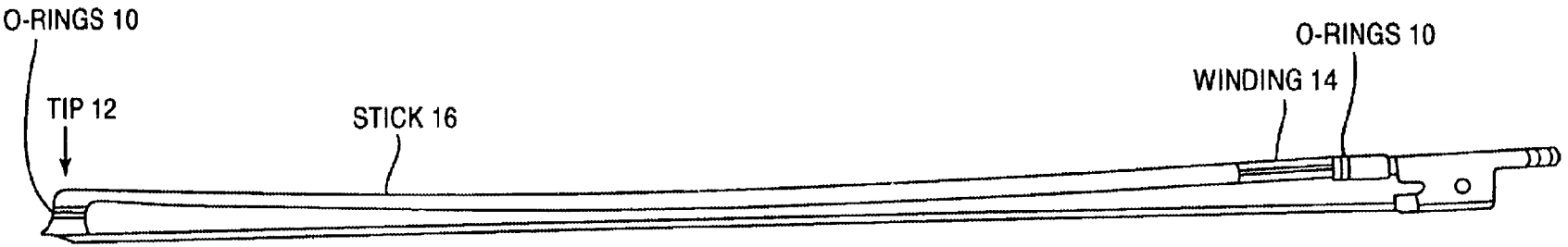
Figure 3:
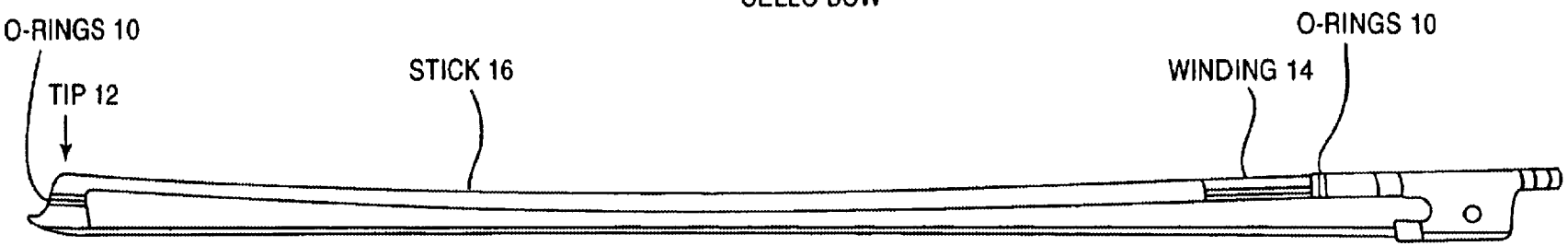
Figure 4:
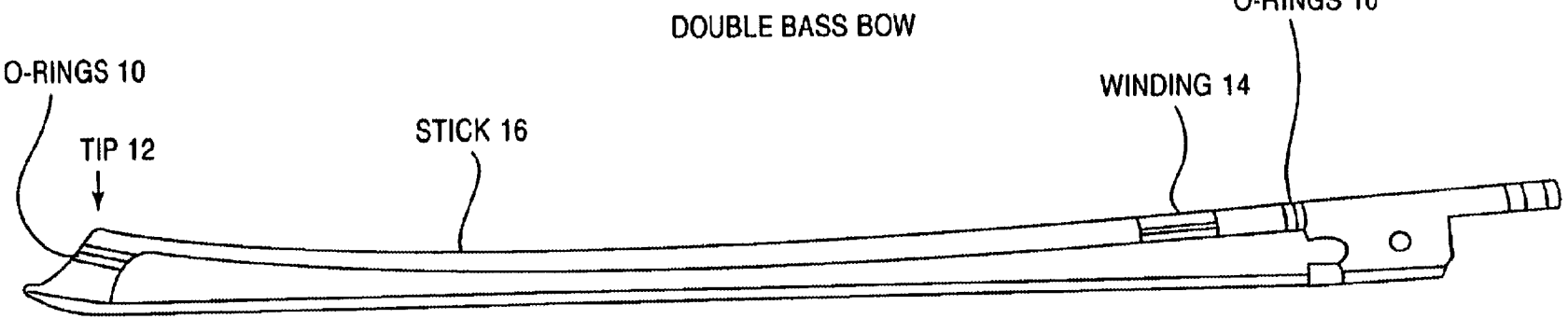

The present inventor has found that, as a professional musician, the placing of a plurality of rubber O-rings at certain locations on a musical instrument, for example, the trumpet, produces a change in the sound produced by the instrument. In particular, with appropriate placement of the rubber O-rings and with an appropriate number and tension (inside diameter) of rings, a "richer, crisper texture" of the sound may be obtained which is more pleasing to the ears. In addition, particularly for wind instruments, the player should find that all other things being equal, a quicker and more precise attack and an increased range of frequencies may be obtained by the player with reduced pressure and effort, resulting in greater endurance during a playing performance.

In relation to firearms, the proper placement of the O-rings at appropriate locations on the barrel, preferably near the muzzle of any firearm, increases the shooting accuracy, produces a tighter grouping of firings, and a reduction in flash, report, and recoil.

The O-rings are the preferred vibration-absorbent material because they are light enough and flexible enough not to interfere with the essential harmonic signature of each particular instrument, and may be strategically placed at particular locations such that unwanted resonances, i.e., "sympathetic vibrations", may be reduced and/or eliminated. The present inventor has particularly found that completely covering the braces connecting the tubing carrying the sound vibration with vibration-absorbent material is particularly desirable, although if O-rings are used in this manner they would have to be placed on the instrument during assembly.

The O-rings are preferably made of Nitrile Butadiene Rubber, which can be compounded for particular applications. The amount of O-ring tension and the number of O-rings required for a particular instrument or firearm are proportional to the amount of vibrational energy to be absorbed.

FIGS. 1–4 show the preferred locations of the O-rings 10 on the bows for the violin, viola, cello and double bass stringed instruments, respectively. As can be seen from the drawings, the O-rings 10 are preferably arranged at the tip 12 and outside winding 14 along stick 16. Preferably, three O-rings 10 are arranged adjacent to one another at each location, for each instrument. The outside diameter, inside diameter, and thickness of the O-rings 10 are preferably 7/16", 5/16", and 1/16", respectively, for both the violin and the viola. For the cello, the outside diameter, inside diameter, and thickness of the O-rings 10 are preferably 1/2", 3/8", and 1/16", respectively. For the double bass, the outside diameter, inside diameter and thickness of the O-rings 10 are preferably 5/8", 1/2" and 1/16", respectively. For these instruments, the damping provided by the O-rings at these locations provides more precise intonation due to damping of extraneous vibrations, thereby affecting the shifting and expressiveness of vibrato for easier control. This, thereby, imparts more freedom in virtuoso performance. Also, because intonation and shifting ability are improved, the variety and quality of tone colors are greatly improved.

FIGS. 5–10 show the preferred location of the O-rings 10 on woodwind instruments, i.e., piccolo, flute, oboe, the upper section of the English horn, clarinet and bassoon, respectively.

Figure 5:
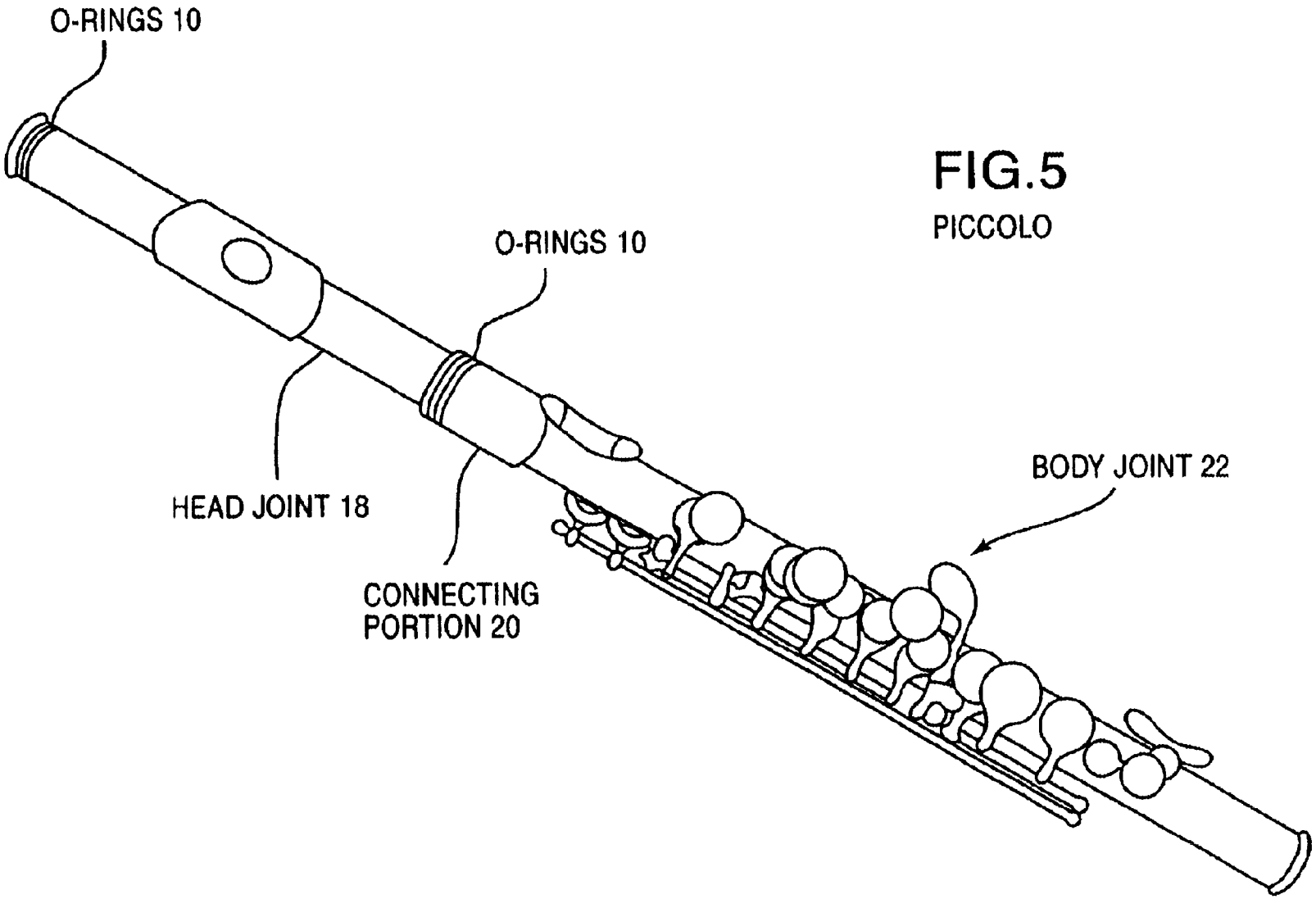
FIGS. 5–10 are plan views of various woodwind instruments showing the preferred locations of the O-rings according to the present invention.

In FIG. 5, preferably three O-rings 10 are arranged at the end of head joint 18 and preferably three O-rings 10 are arranged at the end of the connecting portion 20 of the body joint 22. The O-rings at the end of the head joint 18 preferably have an outside diameter, inside diameter and thickness of ½", ⅜", and 1/16", respectively. The O-rings at the end of the connecting portion 20 of the body joint 22 preferably have an outside diameter, inside diameter, and thickness of 9/16", 7/16", and 1/16", respectively.

Figure 6:
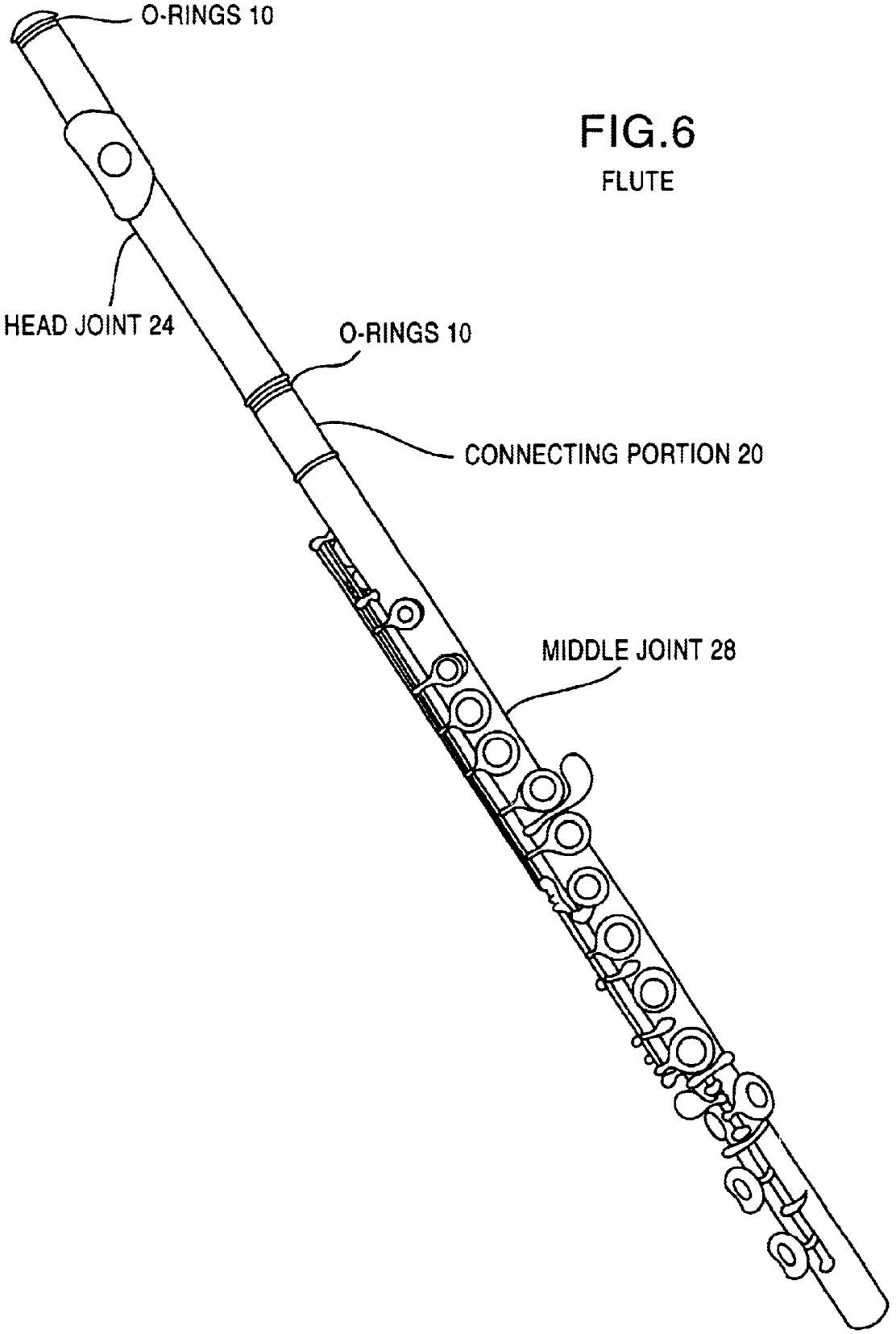

In FIG. 6, preferably four O-rings arranged at the end of head joint 24 and preferably four O-rings 10 are arranged at the end of the connecting portion 20 of middle joint 28. The O-rings 10 arranged at the end of head joint 24, preferably have an outside diameter, inside diameter, and thickness of 13/16", 11/16", and 1/16", respectively. The O-rings 10 at the end of the connecting portion 20 of the middle joint 28 preferably have an outside diameter, inside diameter and thickness of 15/16", 13/16", and 1/16", respectively.

Figure 7:
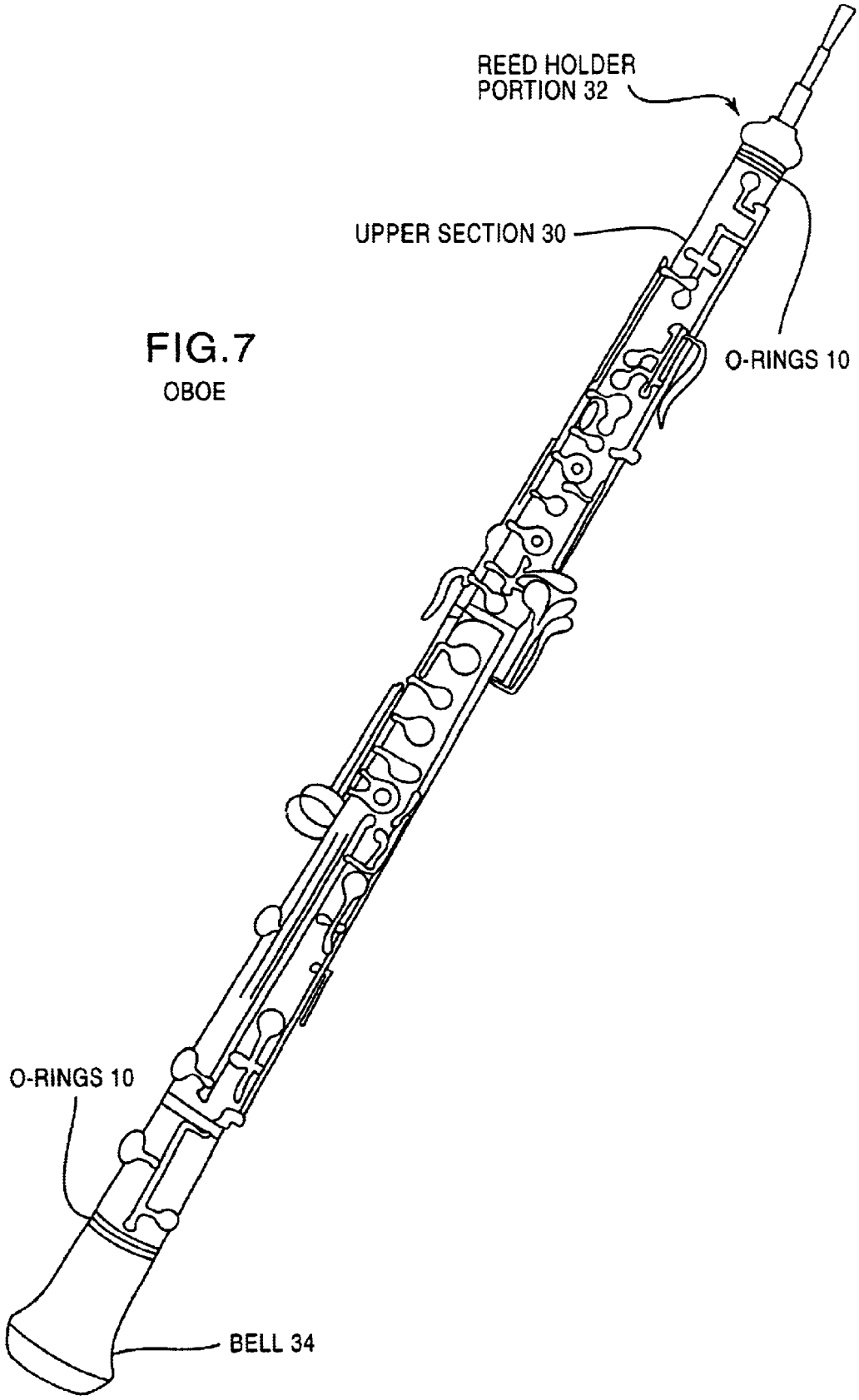

In FIG. 7, preferably three O-rings 10 are arranged at the end of upper section 30 adjacent reed holder portion 32 and preferably eight O-rings 10 are arranged at the mid-portion of bell 34. The three O-rings 10 near the reed holder portion 32 preferably have an outside diameter, inside diameter, and thickness of 13/16", 11/16" and 1/16", respectively, and the eight O-rings 10 on the bell 34 preferably have an outside diameter, inside diameter and thickness of 1⅛", 1" and 1/16", respectively.

Figure 8:
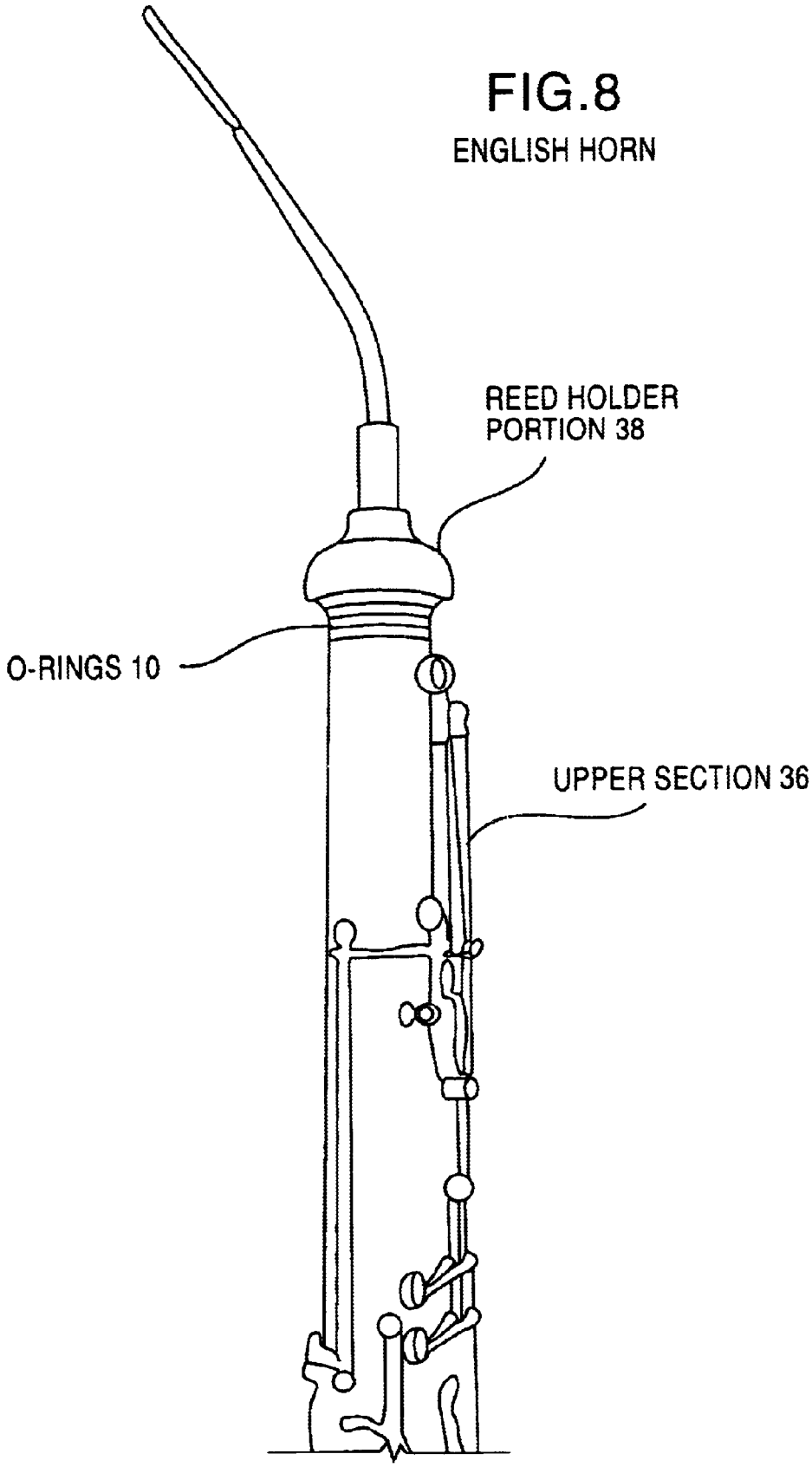

In FIG. 8, preferably five O-rings 10 are arranged at the end of upper section 36 nearest reed-holder portion 38, each O-ring 10 preferably having an outside diameter, inside diameter and thickness of 13/16", 11/16", and 1/16", respectively.

Figure 9:
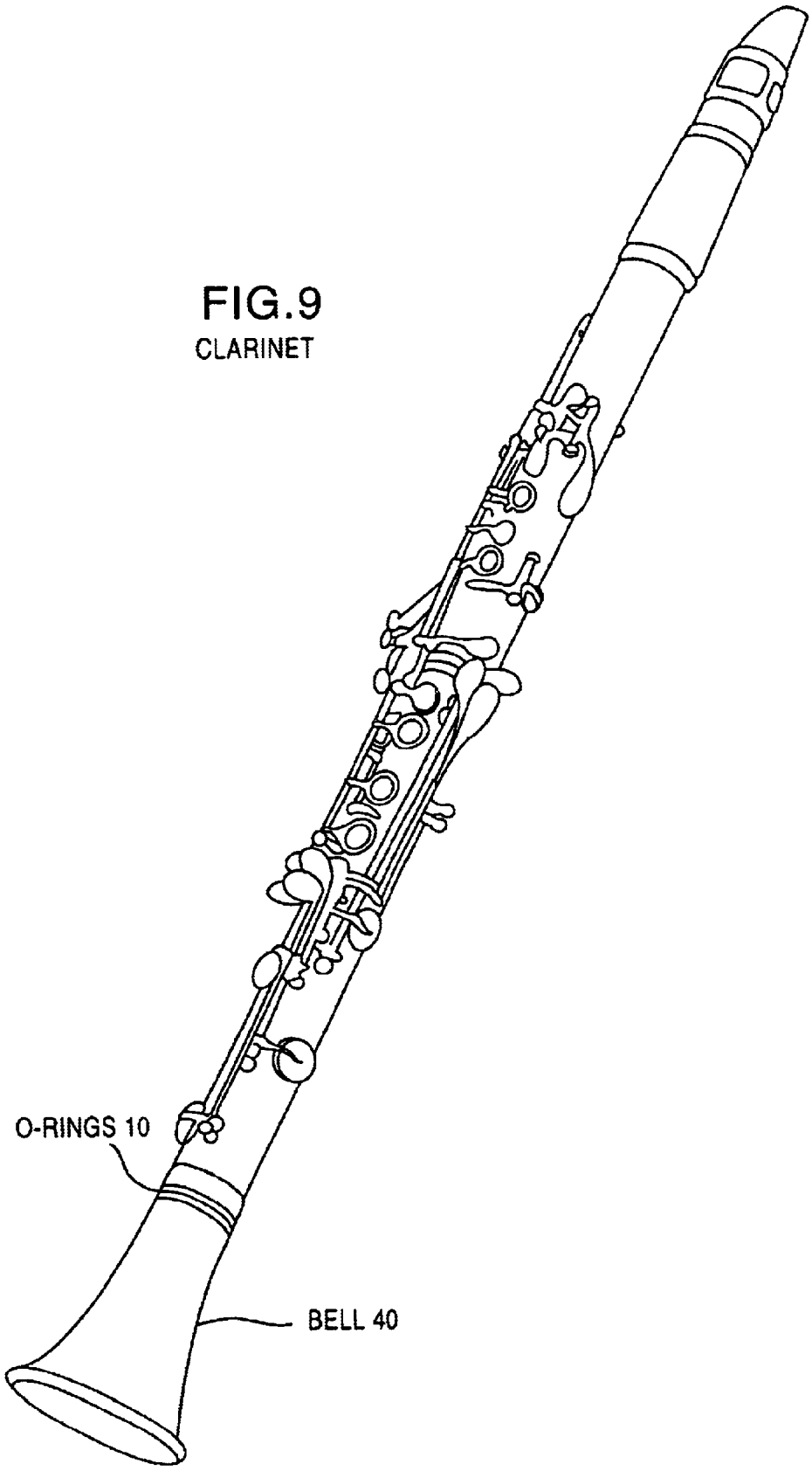

In FIG. 9, preferably three O-rings 10 are arranged at the upper portion of bell 40, each O-ring 10 preferably having an outside diameter, inside diameter and thickness of 13/16", 11/16", and 1/16", respectively.

Figure 10:
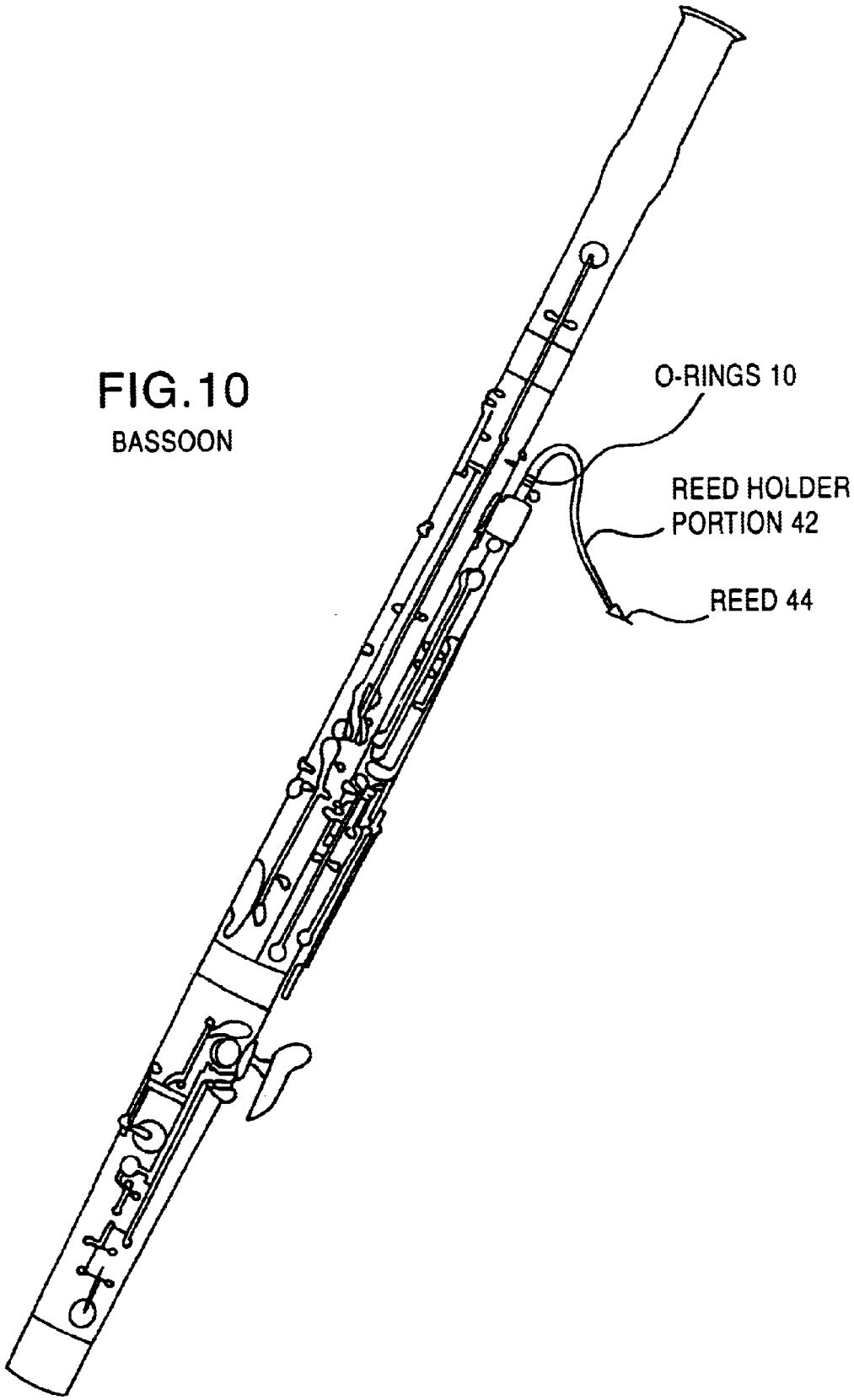

In FIG. 10, preferably eight O-rings 10 are arranged on the reed-holder portion 42 at the end farthest from the reed 44. Each O-ring 10 preferably having an outside diameter, inside diameter and thickness of 7/16", 5/16", and 1/16", respectively.

The O-rings 10 at these locations provide the woodwind instruments with a quicker response time for the attack of each note, along with an improvement in flexibility, more control of tone and pitch, more precise note "lock in", and extended range into the upper and lower registers.

Figure 11:
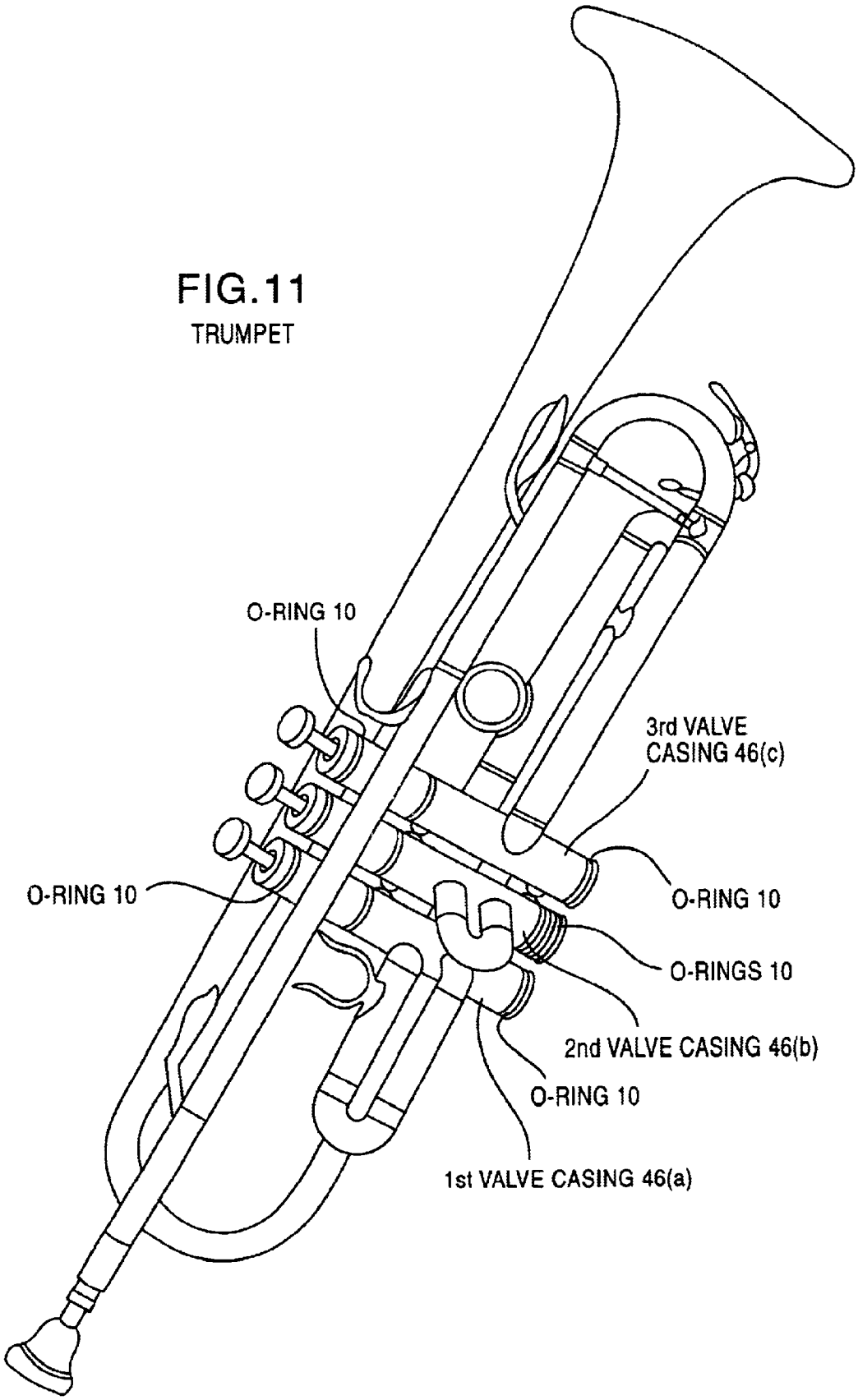
FIGS. 11–14 are plan views of various brass instruments showing the preferred locations of the O-rings according to the present invention.

FIGS. 11–14 disclose preferred embodiments of O-ring placement for brass instruments such as the trumpet, French horn, trombone and tuba, respectively. The respective numbers of O-rings, and dimensions (outside diameter, inside diameter and thickness, in inches) and locations on each instrument are as follows:

Trumpet (FIG. 11)

1 O-ring, 13/16×11/16×1/16, at top of 1st valve casing 46(*a*).

1 O-ring, 13/16×11/16×1/16, at top of 3rd valve casing 46(*c*).

1 O-ring, 13/16×11/16×1/16, at bottom of 1st valve casing 46(*a*).

6 O-rings, 13/16×11/16×1/16, at bottom of 2nd valve casing 46(*b*).

1 O-ring, 13/16×11/16×1/16, at bottom of 3rd valve casing 46(*c*).

Figure 12:
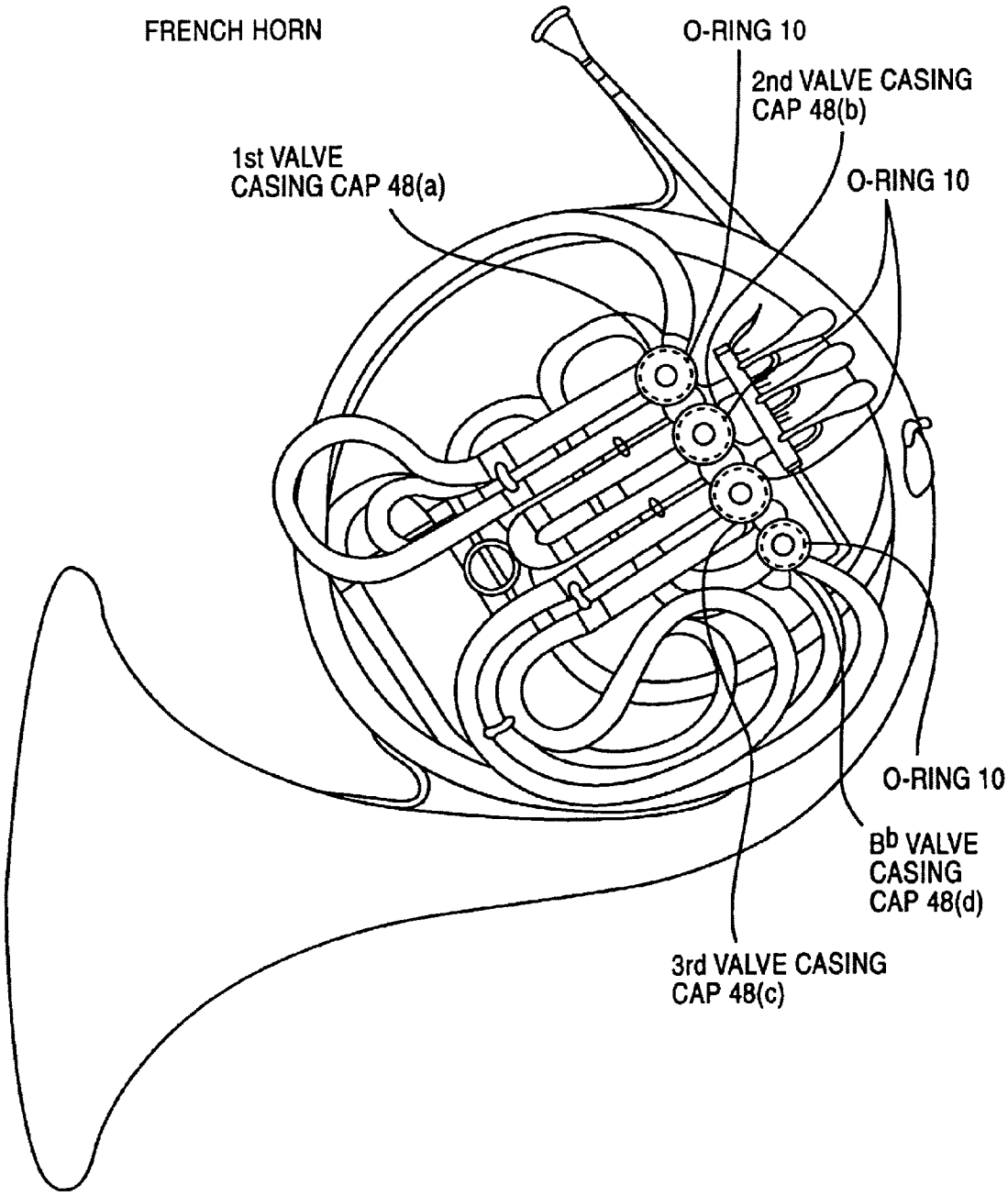

French Horn (FIG. 12)

2 O-rings, 1⅛×1×1/16, below 1st valve casing cap 48(*a*).

4 O-rings, 1⅛×1×1/16, below 2nd valve casing cap 48(*b*).

2 O-rings, 1⅛×1×1/16, below 3rd valve casing cap 48(*c*).

1 O-ring, 1⅛×1×1/16, below $B^b$ valve casing cap 48(*d*).

Figure 13:
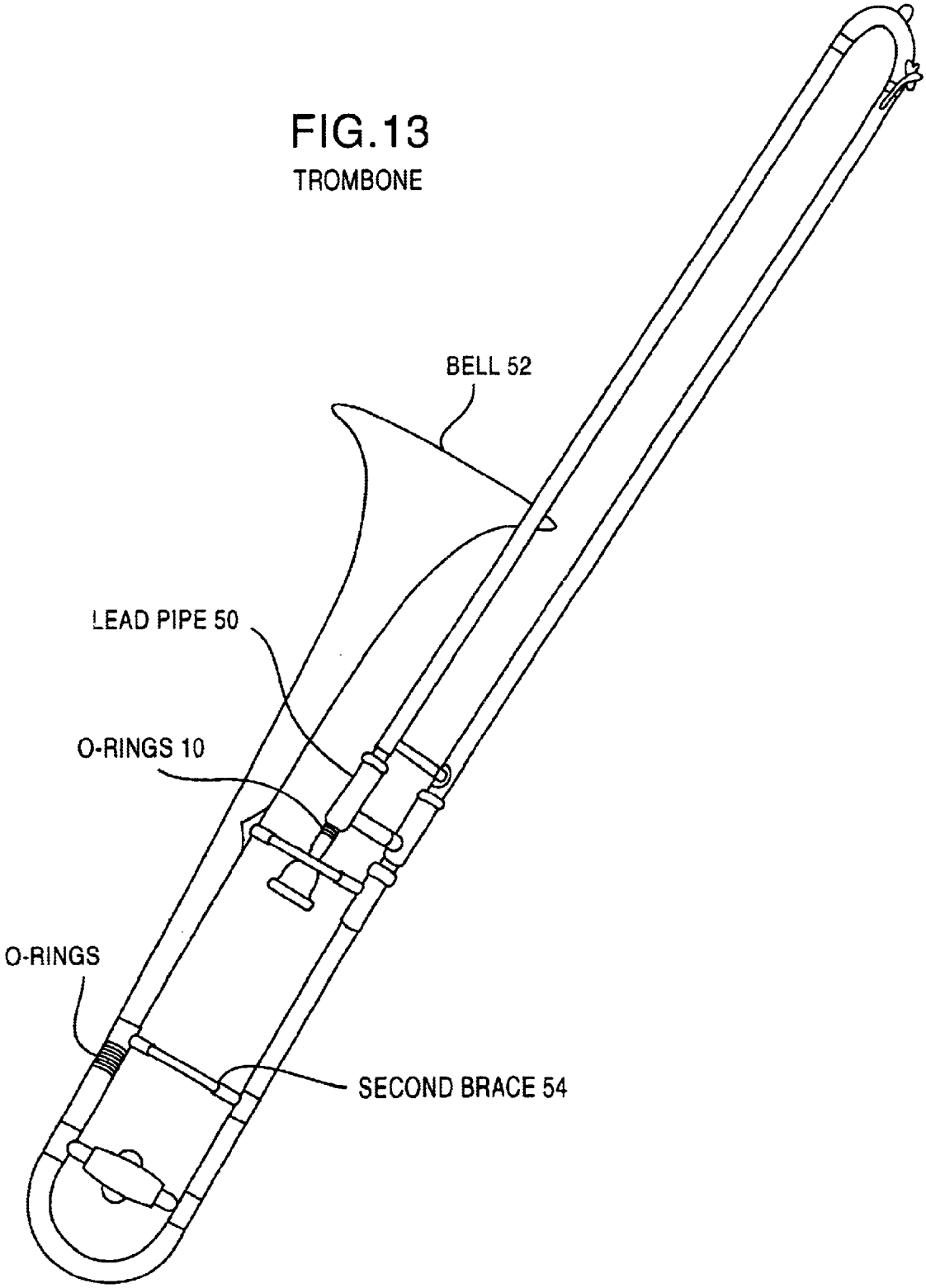

Trombone (FIG. 13)

3 O-rings, ⅝×½×1/16, at beginning of leadpipe 50.

8 O-rings, 13/16×11/16×1/16, at end of bell 52 behind second brace 54.

Figure 14:
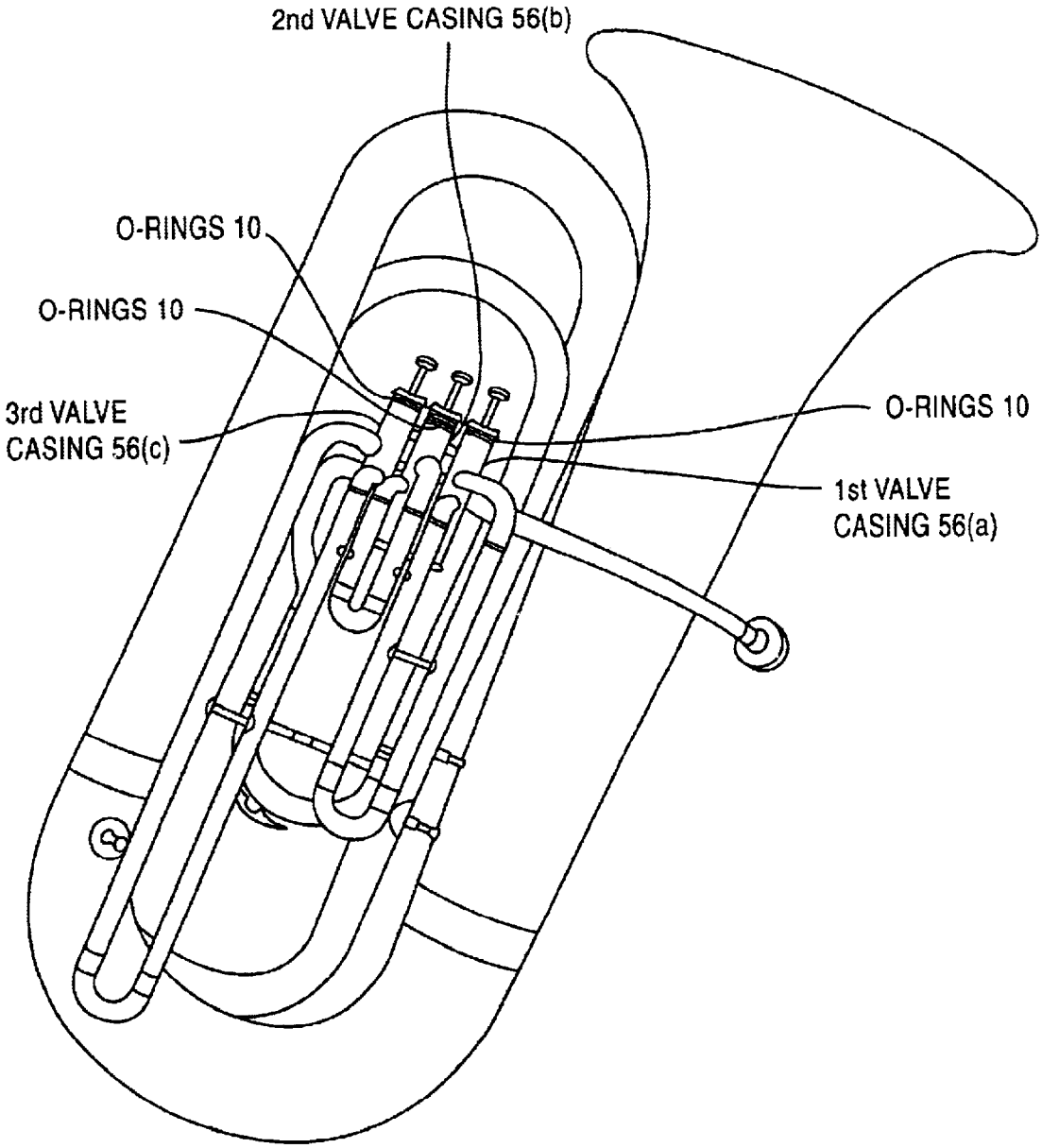

Tuba (FIG. 14)

2 O-rings, 1⅛×1×1/16, at top of 1st valve casing 56(*a*).

4 O-rings, 1⅛×1×1/16, at top of 2nd valve casing 56(*b*).

2 O-rings, 1⅛×1×1/16, at top of 3rd valve casing 56(*c*).

Figure 15:
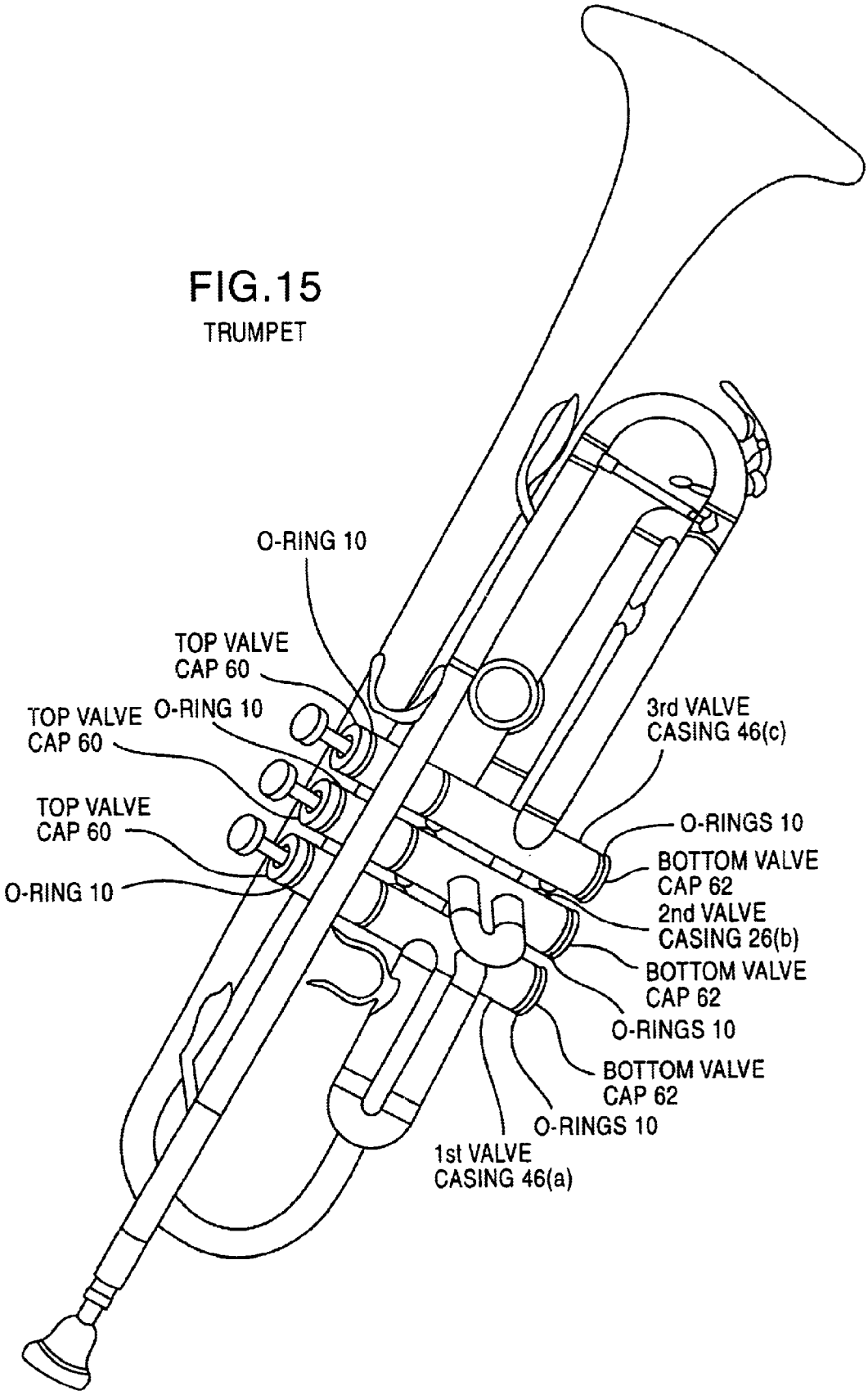
FIGS. 15–16 are plan views of alternate embodiments showing the preferred locations of the O-rings on a trumpet according to the present invention.
Figure 16:
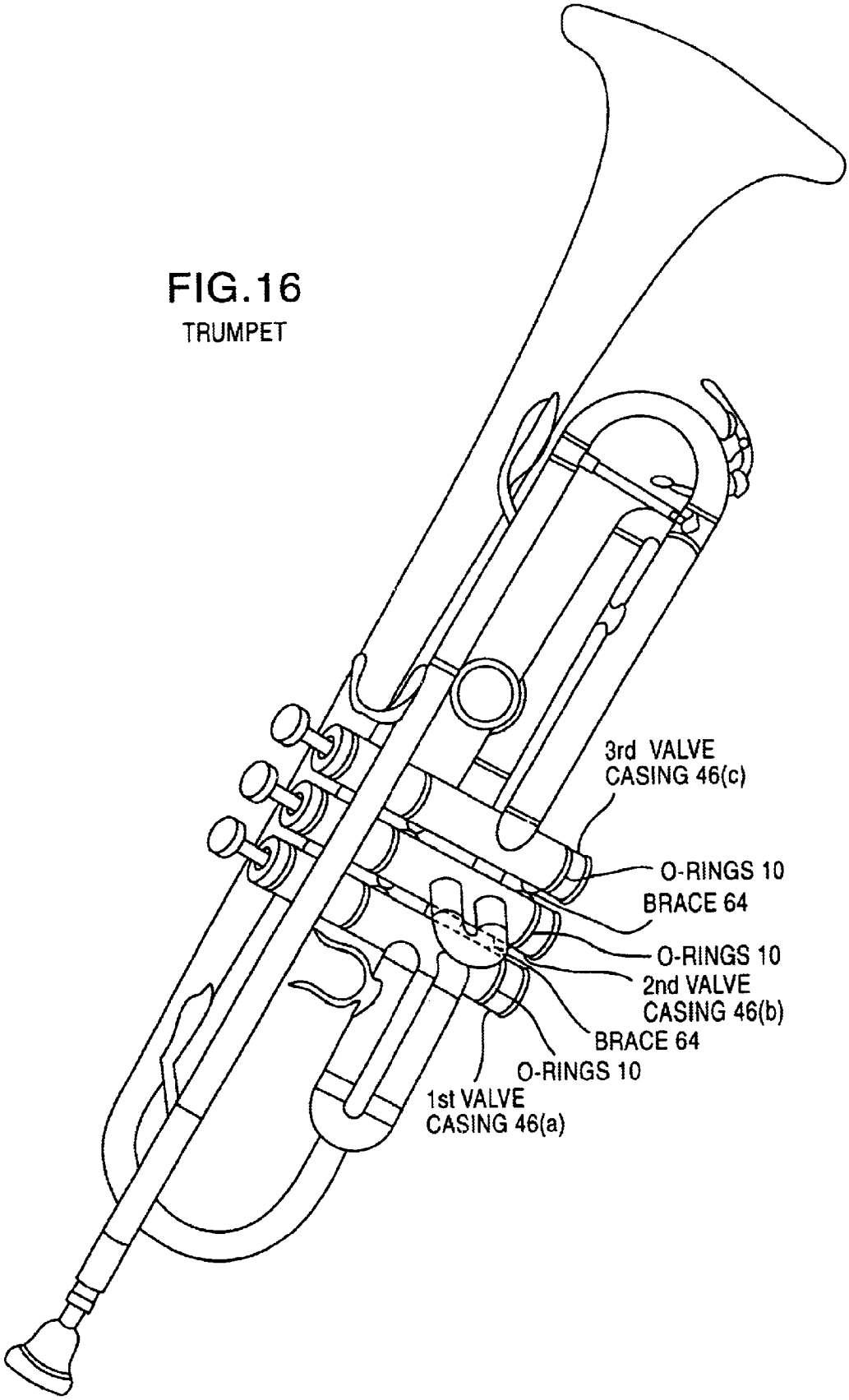

FIGS. 15–16 disclose alternate embodiments of O-ring placement for the trumpet. The respective numbers of O-rings, dimension (outside diameter, inside diameter and thickness, in inches) and locations on the trumpet for this embodiment are as follows:

Trumpet (FIG. 15)

On 1st valve casing 46(*a*)—1 O-ring, 13/16×11/16×1/16, below top valve cap 60; 2 O-rings, 13/16×11/16×1/16, above bottom valve cap 62.

On 2nd valve casing 46(*b*)—1 O-ring, 13/16×11/16×1/16, below top valve cap 60; 2 O-rings, 13/16×11/16×1/16, above bottom valve cap 62.

On 3rd valve casing 46(*c*)—1 O-ring, 13/16×11/16×1/16, below top valve cap 60; 2 O-rings, 13/16×11/16×1/16, above bottom valve cap 62.

Trumpet (FIG. 16)

On 1st valve casing 46(*a*): 2 O-rings below brace 64, each 13/16×11/16×1/16.

On 2nd valve casing 46(*b*): 2 O-rings below brace 64, each 13/16×11/16×1/16.

On 3rd valve casing 46(*c*): 2 O-rings below brace 64, each 13/16×11/16×1/16.

Figure 17:
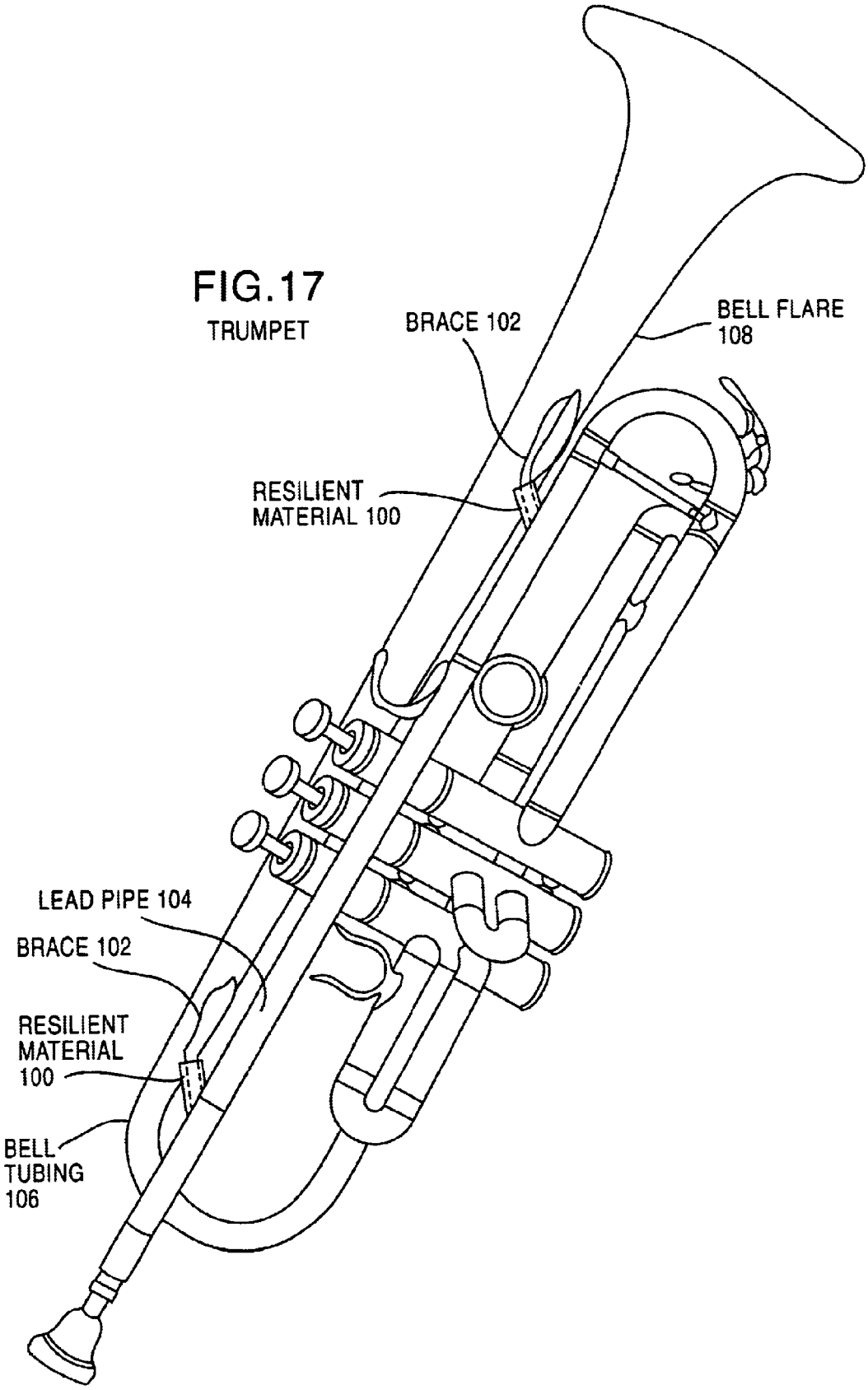
FIGS. 17–19 are plan views of various brass instruments showing the preferred locations of resilient material on the bracing structure according to the present invention.
Figure 18:
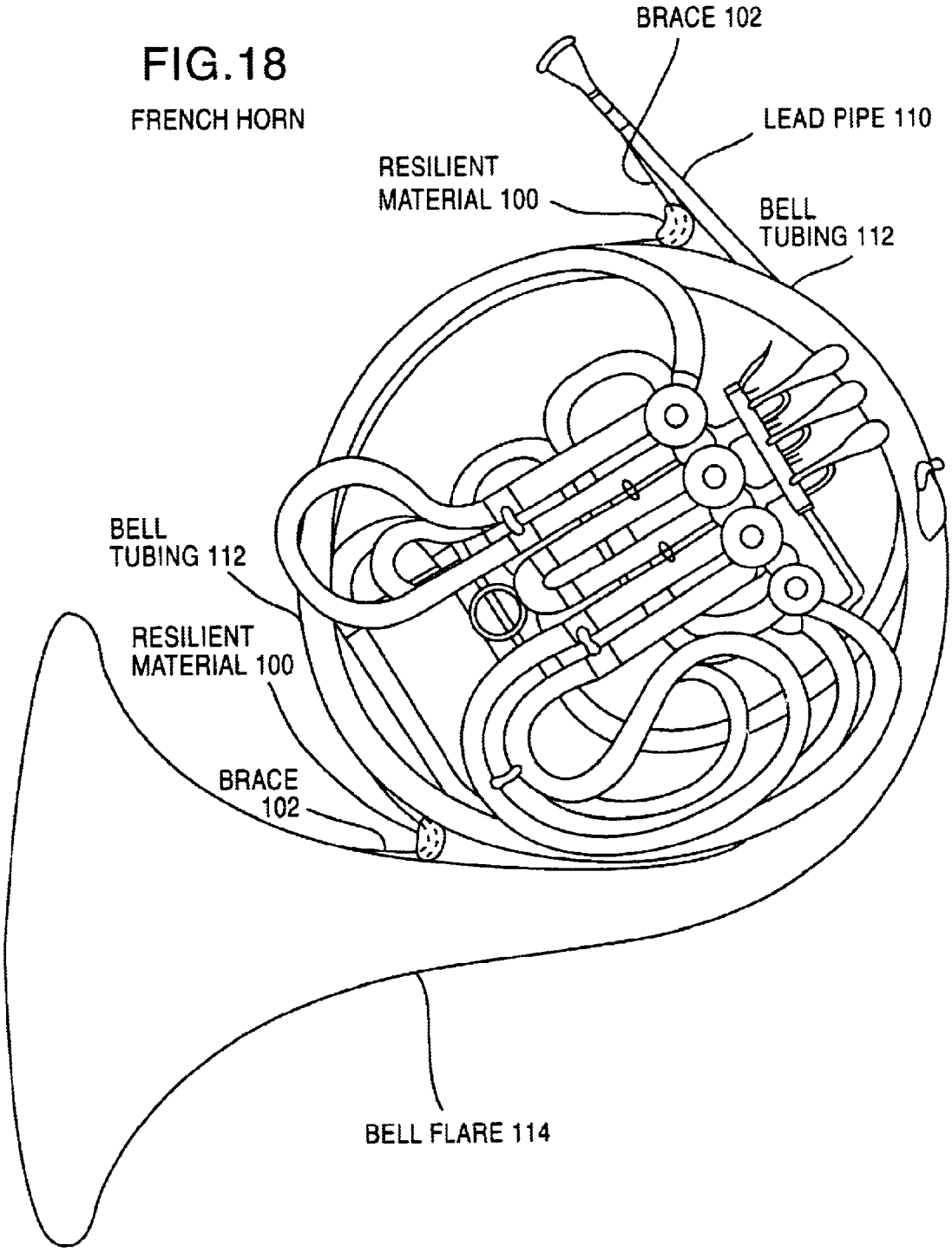
Figure 19:
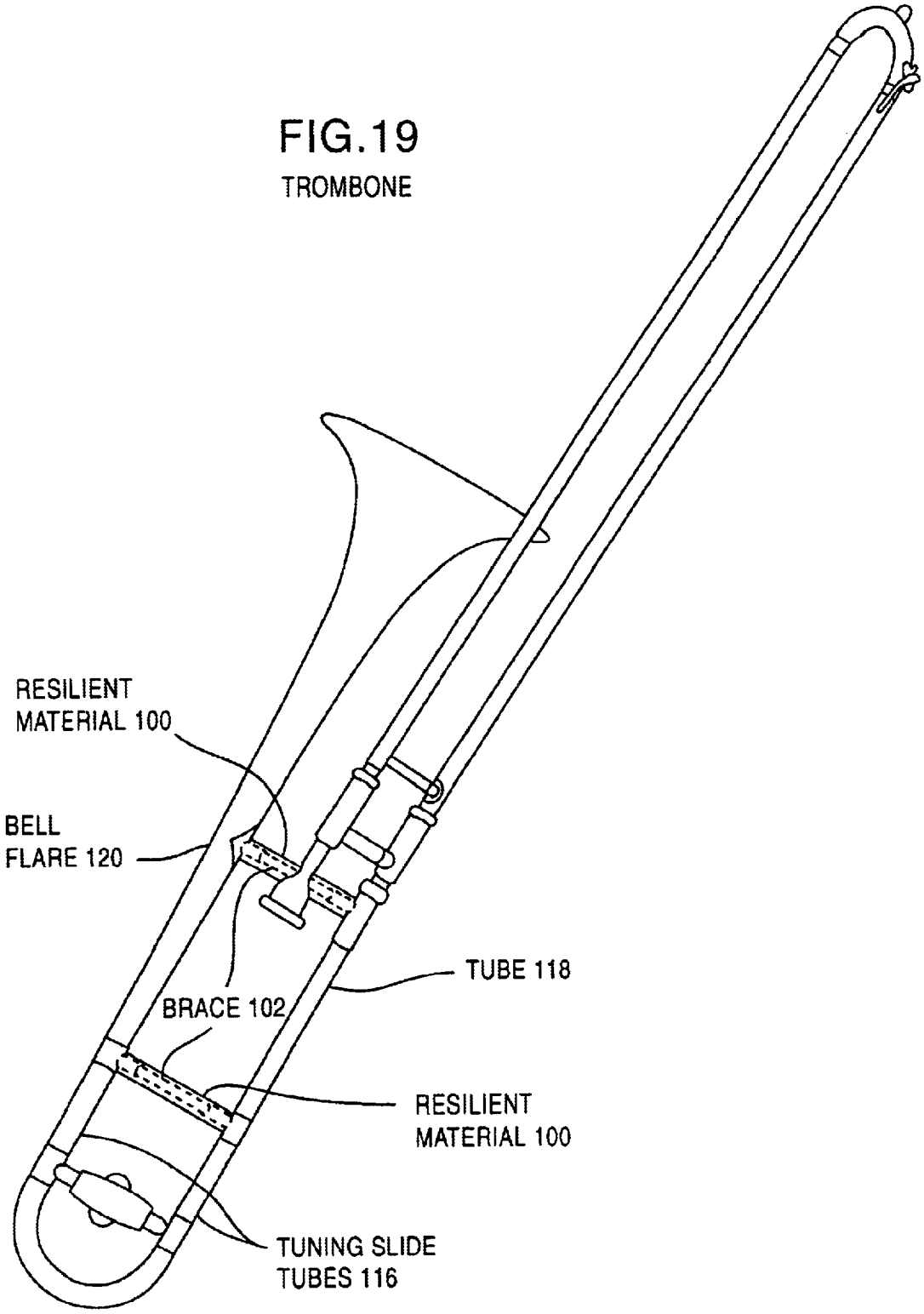

FIGS. 17–19 disclose preferred embodiments of locations of resilient material 100 at various locations on braces 102 appearing on the trumpet, French horn, and trombone, respectively. The resilient material 100 is preferably vibration absorbent such as neoprene rubber, and should be applied under tension during assembly of the instruments prior to attachment of the braces 102. Otherwise, the braces 102 would have to be removed from an assembled instrument in order to have the resilient material 100 applied to the braces 102 while under tension.

The preferred locations of the resilient material 100 on the braces 102 for these instruments are as follows:

Trumpet (FIG. 17)

Resilient material 100 on brace 102 connecting leadpipe 104 and bell tubing 106.

Resilient material 100 on brace 102 connecting end of leadpipe and bell flare 108.

French Horn (FIG. 18)

Resilient material 100 on brace 102 connecting leadpipe 110 and bell tubing 112.

Resilient material 100 on brace 102 connecting bell tubing 112 to bell flare 114.

Trombone (FIG. 19)

Resilient material 100 on brace 102 connecting tuning slide tubes 116.

Resilient material 100 on brace 102 connecting tube 118 to bell flare 120.

Figure 20:
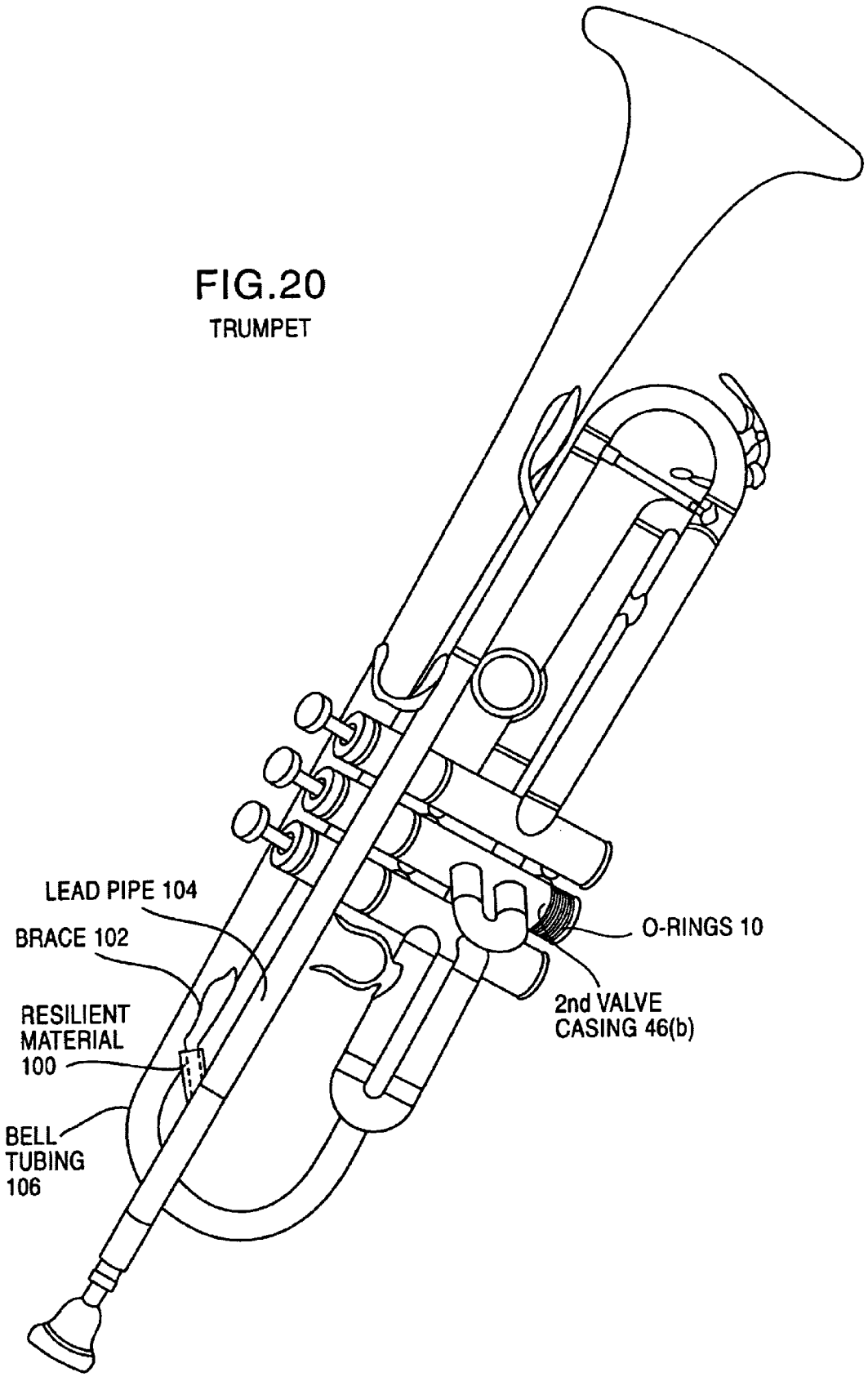
FIG. 20 is a plan view of another alternate embodiment showing the preferred location of both resilient material on the bracing structure and O-rings on a trumpet according to the present invention.

Trumpet (FIG. 20)

FIG. 20 shows an alternate embodiment of the preferred location of both the resilient material 100 on the bracing structure and O-rings on a trumpet.

The resilient material 100 is preferably arranged on brace 102 connecting leadpipe 104 and bell tubing 106. Preferably eight O-rings 10 are arranged at the bottom of $2^{nd}$ valve casing 46(*b*) and preferably have an outside diameter, inside diameter and thickness of $^{13}/_{16}\times^{11}/_{16}\times^{1}/_{16}$ inches, respectively.

The aforementioned preferred embodiments regarding O-rings and/or resilient material placement for brass instruments have been found by the inventor to reduce the blowing resistance of the horn, providing a quicker response time for the attack of each note, along with an improvement in flexibility, more control of tone and pitch, more precise note "lock-in" and extended range into the upper and lower registers.

Figure 21:
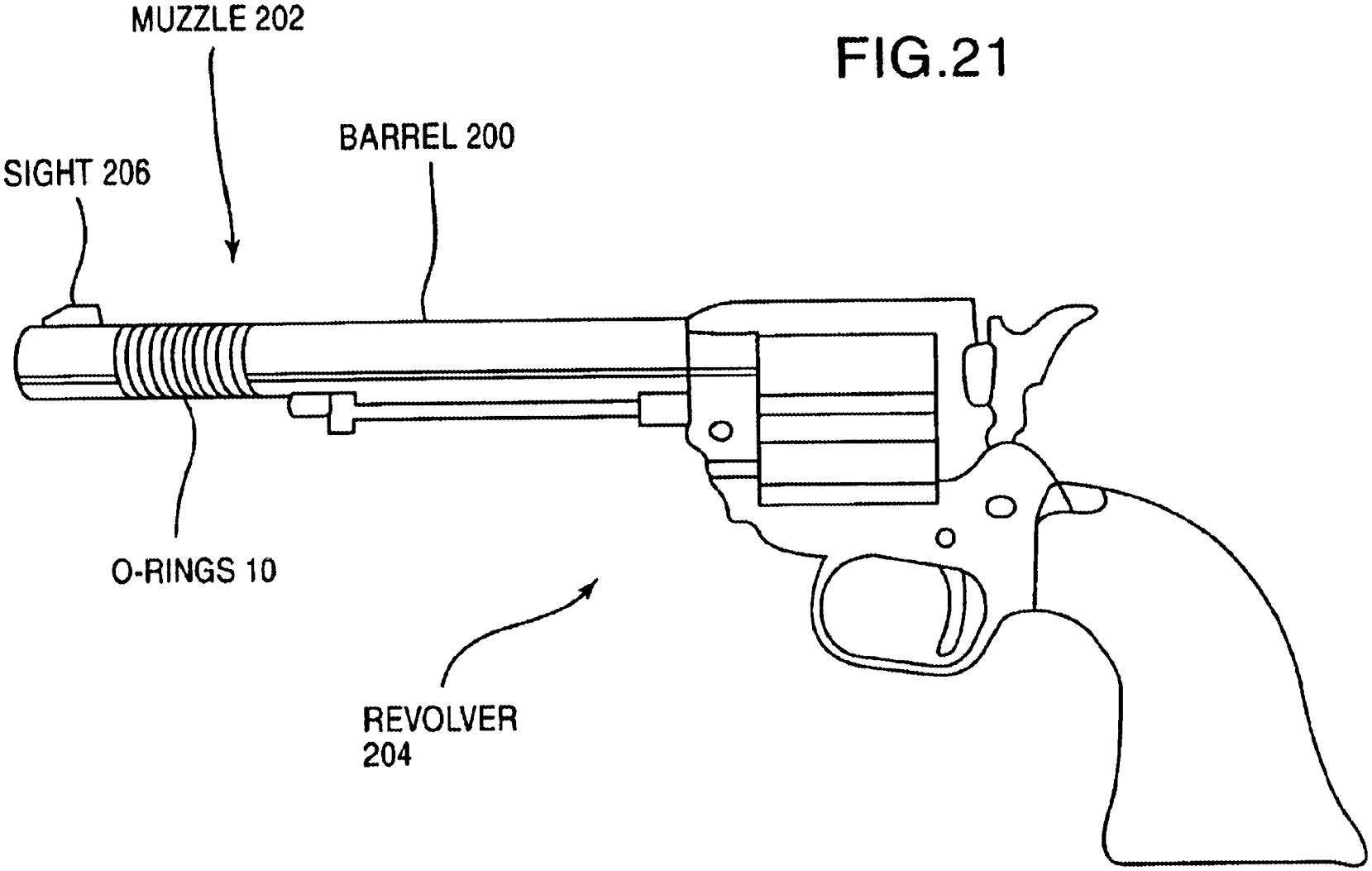
FIG. 21 is a plan view of a revolver showing the preferred location of the O-rings according to the present invention.
Figure 22:
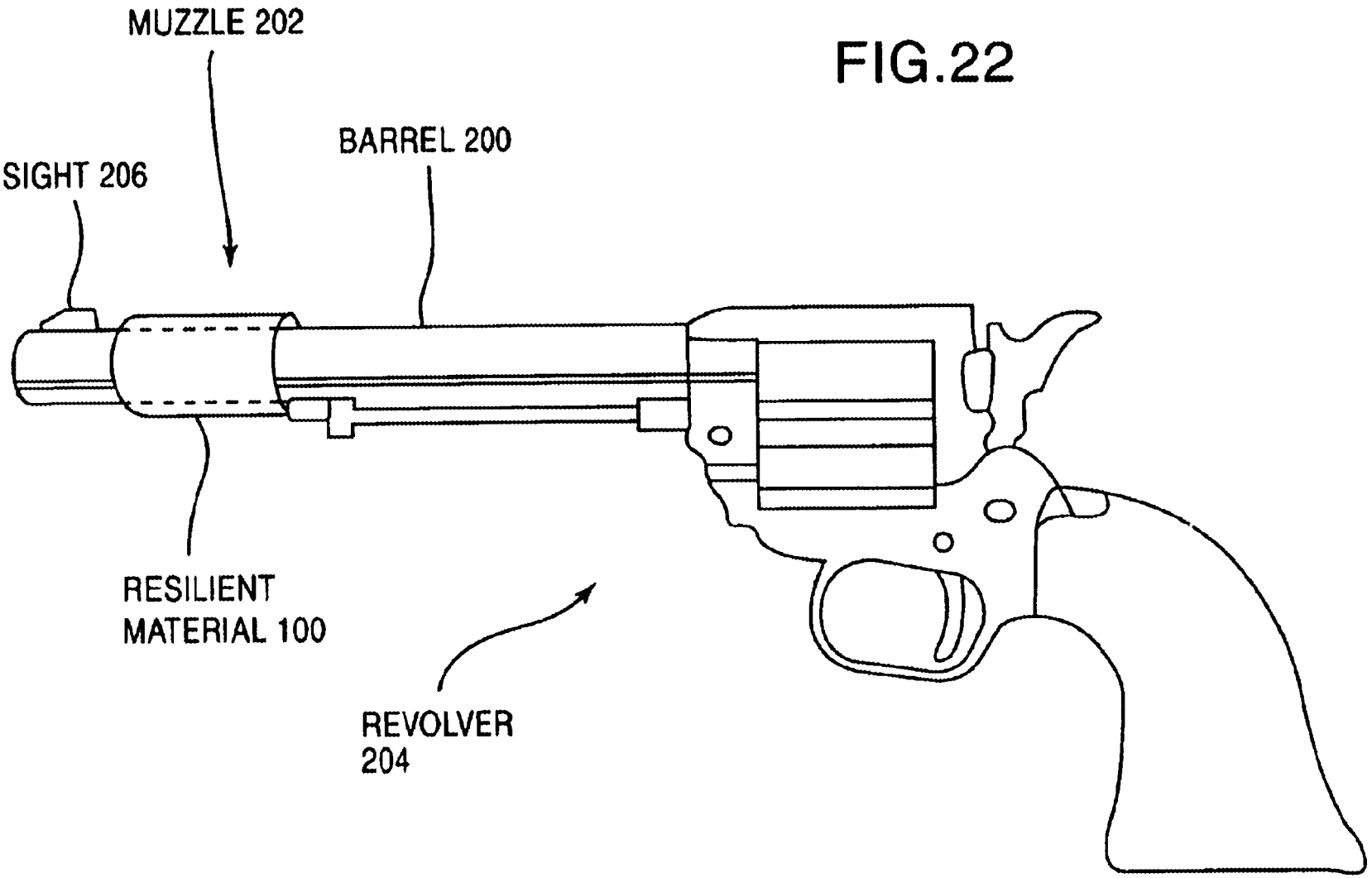
FIG. 22 is a plan view of a revolver showing the preferred location of the resilient material according to the present invention.

The present invention can also be applied to firearms. The inventor has found that placement of a plurality of O-rings on the barrel near the muzzle of any firearm increases the shooting accuracy, produces a tighter grouping of firings and reduces flash, report and recoil. FIG. 21 shows placement of a plurality of O-rings 10 along the barrel 200 on the muzzle 202 of a revolver 204 behind the sight 206. Alternatively, the O-rings may be replaced by resilient material 100, as shown in FIG. 22.

What is claimed is:

1. A harmonic vibration damping device for a musical stringed instrument including a hand-held bow with a string connected under tension to an end portion and an open winding portion of said bow, said string being moved across one or a plurality of other strings of said instrument to produce said vibrations at a resonant frequency, comprising:

at least one mass of sound-absorbent material surrounding at least one of said tip portion of said bow and said outside winding portion of said bow.

2. The harmonic vibration damping device of claim 1, wherein said mass of vibration-absorbent material consists of at least one ring of resilient material.

3. The harmonic vibration damping device of claim 1, wherein said at least one ring of resilient material consists of at least one O-ring made of rubber.

4. A harmonic vibration damping device for a musical wind instrument, the musical wind instrument including at least one tubular portion holding a column of air producing sound vibrations at a resonant frequency, comprising:

a predetermined number of O-rings made of rubber surrounding said at least one tubular portion under tension are arranged at a plurality of predetermined locations along the length of said at least one tubular portion.

5. The harmonic vibration damping device of claim 4, wherein said musical wind instrument is a woodwind instrument.

* * * * *